US011745051B2

(12) United States Patent
Modeste et al.

(10) Patent No.: US 11,745,051 B2
(45) Date of Patent: Sep. 5, 2023

(54) TRACK EXERCISE DEVICE

(71) Applicant: HIGH STREET TV (GROUP) LIMITED, North Yorkshire (GB)

(72) Inventors: Luke Modeste, North Yorkshire (GB); Josh Hume, West Yorkshire (GB)

(73) Assignee: HIGH STREET TV (GROUP) LIMITED, North Yorkshire (GB)

( * ) Notice: Subject to any disclaimer, the term of this patent is extended or adjusted under 35 U.S.C. 154(b) by 105 days.

(21) Appl. No.: 16/958,333

(22) PCT Filed: Dec. 12, 2019

(86) PCT No.: PCT/EP2019/084861
§ 371 (c)(1),
(2) Date: Jun. 26, 2020

(87) PCT Pub. No.: WO2020/156723
PCT Pub. Date: Aug. 6, 2020

(65) Prior Publication Data

US 2021/0213324 A1 Jul. 15, 2021

(30) Foreign Application Priority Data

Jan. 31, 2019 (GB) ..... 1901326

(51) Int. Cl.
*A63B 21/00* (2006.01)
*A63B 23/12* (2006.01)
(Continued)

(52) U.S. Cl.
CPC ..... *A63B 21/4035* (2015.10); *A63B 23/1209* (2013.01); *A63B 21/0552* (2013.01);
(Continued)

(58) Field of Classification Search
CPC . A63B 21/04; A63B 21/0428; A63B 21/0442; A63B 21/05; A63B 21/0552;
(Continued)

(56) References Cited

U.S. PATENT DOCUMENTS 3,559,986 A * 2/1971 Ehrmantraut ..... A63B 23/0488 482/70
3,582,069 A * 6/1971 Flick ..... A63B 22/203 601/33

(Continued)

FOREIGN PATENT DOCUMENTS

KR 20150123544 A * 11/2015 ..... A63B 22/16

OTHER PUBLICATIONS

Partial International Search Report, PCT/EP2019/084861.

*Primary Examiner* — Gary D Urbiel Goldner
(74) *Attorney, Agent, or Firm* — NIXON & VANDERHYE

(57) ABSTRACT

A track exercise device with at least first and second substantially parallel tracks, and first, second, third, and fourth movable platforms. The first and third movable platforms are movable on the first track, and the second and fourth movable platforms are movable on the second track. Transverse attachments selectively and respectively attach the first and second movable platforms together on the first and second tracks and the third and fourth movable platforms together on the first and second tracks. Longitudinal attachments selectively and respectively attach the first and third movable platforms together on the first track and the second and fourth movable platforms together on the second track. A tilting adjustment selectively provides for inclined or flat movement of the first, second, third, and fourth movable platforms.

19 Claims, 13 Drawing Sheets

(51) Int. Cl.

| | |
|---|---|
| ***A63B 21/055*** | (2006.01) |
| ***A63B 23/035*** | (2006.01) |
| ***A63B 23/04*** | (2006.01) |
| ***A63B 71/02*** | (2006.01) |

(52) U.S. Cl.
CPC . *A63B 23/03525* (2013.01); *A63B 2023/0411* (2013.01); *A63B 2071/025* (2013.01); *A63B 2208/0219* (2013.01)

(58) Field of Classification Search
CPC . A63B 21/062; A63B 21/0622; A63B 21/068; A63B 21/4027; A63B 21/4029; A63B 21/4031; A63B 21/4033; A63B 21/4034; A63B 21/4035; A63B 21/4045; A63B 22/001; A63B 22/0012; A63B 22/0023; A63B 22/0046; A63B 22/0076; A63B 22/0087; A63B 22/20; A63B 22/201; A63B 22/203; A63B 22/205; A63B 2022/0033; A63B 2022/0035; A63B 2022/0038; A63B 2022/0041; A63B 2022/0079; A63B 23/0211; A63B 23/0216; A63B 23/0222; A63B 23/035; A63B 23/03516; A63B 23/03525; A63B 23/03533; A63B 23/03541; A63B 23/0355; A63B 23/03575; A63B 23/04; A63B 23/0405; A63B 23/0417; A63B 23/0482; A63B 23/0488; A63B 23/12; A63B 23/1209; A63B 23/1218; A63B 23/1236; A63B 23/1245; A63B 23/1254; A63B 2023/0411; A63B 69/0022; A63B 69/06; A63B 69/18; A63B 69/182; A63B 2069/062; A63B 71/02; A63B 71/023; A63B 2071/025; A63B 2208/0204; A63B 2208/0214; A63B 2208/0219; A63B 2208/0228; A63B 2208/0223; A63B 2208/0242; A63B 2208/0252; A63B 2208/0295; A63B 2225/10; A63B 2244/18; A63B 2244/19
See application file for complete search history.

(56) References Cited

U.S. PATENT DOCUMENTS

| | | | | |
|---|---|---|---|---|
| 3,834,693 | A * | 9/1974 | Poppenberger | A63B 69/18 482/146 |
| 4,679,786 | A * | 7/1987 | Rodgers | A63B 21/154 482/54 |
| D622,787 | S * | 8/2010 | Masterson | A63B 69/0022 D21/668 |
| D623,244 | S * | 9/2010 | Hoffman | A63B 21/068 D21/668 |
| 2001/0036885 | A1 | 11/2001 | Castellot et al. | |
| 2005/0245367 | A1* | 11/2005 | Horvath | A63B 21/068 482/93 |
| 2007/0238583 | A1* | 10/2007 | Cunningham | A63B 23/03541 482/52 |
| 2009/0098983 | A1* | 4/2009 | Hoffman | A63B 69/0022 482/70 |
| 2012/0108405 | A1* | 5/2012 | Milo | A63B 23/0222 482/142 |
| 2014/0005008 | A1* | 1/2014 | Ho | A63B 23/0216 482/96 |
| 2014/0011645 | A1 | 1/2014 | Johnson et al. | |
| 2014/0031175 | A1 | 1/2014 | Peralo | |
| 2014/0100088 | A1* | 4/2014 | Ho | A63B 22/205 482/131 |
| 2014/0100089 | A1 | 4/2014 | Kermath et al. | |
| 2017/0182351 | A1* | 6/2017 | Scarborough | A63B 23/1209 |

* cited by examiner

TRACK EXERCISE DEVICE

FIELD OF THE INVENTION

Generally, the present invention relates to exercise devices. In particular, the present invention pertains to track exercise devices.

BACKGROUND

Today, there are some track exercise devices available. However, the devices that exist today have some drawbacks.

Usually only a few different exercise movements can be performed with one device. This means that a user will have to acquire many different devices to be able to perform all the different exercise movements that he/she wants to perform.

Usually, the track exercise devices only have one moving platform which also limits the possibilities for performing different exercise movements. For example, a rowing machine is a track exercise device with one moving platform. With this device, the user can move back and forth with the platform while doing some rowing exercises by pulling a handle.

Further, the track exercise devices available today may have shaky track arrangements that do not allow smooth workouts with the devices. This may provide a poor user experience for the exerciser.

The track exercise devices with an inclining option tend to have a fixed support part at the end of the device. The fixed support part is part of the device structure so that the track portion may be adjusted along the support part. Since the support part is a fixed part, the track exercise devices may require a lot of space and are difficult to store.

The attachment means used in exercise devices today may also have drawbacks. In some instances, the attachment means are not strong enough. Latches and other typical attachments may disconnect or come loose during use. The attachment means may also come out of the structure thus providing an uneven surface, or the attachment means may in some other way be in the way of the user. This may again provide a poor user experience for the exerciser when performing exercise movements with such devices.

SUMMARY OF THE INVENTION

The objective is to at least alleviate the problems described hereinabove not satisfactorily solved by the known arrangements, and to provide a feasible track exercise device. One objective is to provide a track exercise device with attachable/detachable movable platforms allowing multiple different exercise movements. Another objective is to provide attachment means that do not disturb the user. A further objective is to provide a track exercise device allowing both flat and inclined movements. A further objective is to provide attachable/detachable tilting means that are convenient when storing the device. A further objective is to provide a track exercise device with strength and stability. A further objective is to provide smooth motion of the movable platforms. A further objective is to provide means for assistance or resistance.

The aforesaid objectives are achieved by the embodiments of the track exercise device according to the present invention.

The aforesaid objectives are achieved according to the present invention as claimed in claim 1.

Accordingly, in one aspect of the present invention a track exercise device comprises at least two substantially parallel tracks, at least four movable platforms, wherein at least two movable platforms are on a first track, and wherein at least two movable platforms are on a second track, transverse attachment means for attaching the movable platforms on adjacent tracks, longitudinal attachment means for attaching the movable platforms on the same track, tilting means for inclined or flat movement.

In one embodiment, at least a first and a second movable platform comprise respectively a first and a second slot, each slot comprising at least two holes, wherein the transverse attachment means comprise at least a first and a second detachable connecting part that in a first position attaches the first and the second movable platform, when the first and the second connecting part are arranged in the holes of both the first and the second movable platform, and wherein the connecting parts release the first and the second movable platform in a second position, when the first connecting part is arranged in the holes of the first movable platform and the second connecting part is arranged in the holes of the second movable platform.

In one embodiment, the connecting parts form a flat surface with the movable platforms.

In one embodiment, the longitudinal attachment means comprise a rotatable hook for attaching the two movable platforms on the same track.

In one embodiment, the tilting means comprise at least one detachable incline leg that is attachable to the first end of the track exercise device below the tracks.

In one embodiment, the track exercise device comprises double tracks, wherein a double track comprises at least two substantially parallel track bars for providing strength and stability to the structure of the track exercise device.

In one embodiment, the movable platforms comprise double rollers, a double roller comprising two roll surfaces.

In one embodiment, the movable platforms comprise at least four double rollers, wherein at least two double rollers are arranged above the track and at least two double rollers are arranged below the track for smooth motion.

In one embodiment, the track exercise device comprises at least one or two elastic bands for providing resistance or assistance for exercise movements.

In one embodiment, at least a first and a second elastic band are attachable respectively to a first and a second movable platform and to a first and second attachment point at one end of the track exercise device.

In one embodiment, the elastic bands are extendable.

In one embodiment, the track exercise device comprises at least two pull handles.

In one embodiment, the track exercise device comprises at least two pulleys, wherein a first and a second pull handle attach respectively via a first and second pulley to a first and a second movable platform.

In one embodiment, the track exercise device comprises at least one detachable handle attachable to the first end of the track exercise device.

In one embodiment, the detachable handle is at least one selected from the group of a grip bar, a roll bar and a lat bar.

In one embodiment, the track exercise device comprises a detachable squat platform attachable to the second end of the track exercise device.

Accordingly, in a second aspect of the present invention attachment means for an exercise device comprises at least a first and a second detachable connecting part that in a first position attaches a first and a second movable platform, when the first and the second connecting part are arranged in holes of both the first and the second movable platform, and wherein the connecting parts release the first and the second movable platform in a second position, when the first connecting part is arranged in the holes of the first movable platform and the second connecting part is arranged in the holes of the second movable platform.

The utility of the present invention follows from a plurality of factors depending on each particular embodiment.

In some embodiments, the movable platforms may be attachable/detachable, allowing the performance of multiple different exercise movements. In some embodiments, the attachment means may provide a flat surface that does not disturb the user. In some embodiments, the track exercise device may allow both flat and inclined movements. In some embodiments, the tilting means may be attachable/detachable and thus convenient when storing the device. In some embodiments, the track exercise device may have strength and stability. In some embodiments, the movable platforms may have smooth motion. In some embodiments, the track exercise device may comprise means for assistance or resistance.

The expression "a number of" refers herein to any positive integer starting from one (1), e.g. to one, two, or three.

The expression "a plurality of" refers herein to any positive integer starting from two (2), e.g. to two, three, or four.

In this application, the expression "substantially parallel" refers to bars, tracks and other parts that need to be mostly parallel for the device to function properly. However, in some embodiments, a slight deviation from a completely parallel arrangement is possible for the device to still function. For example, in some embodiments, a deviation of 5 or 10 degrees may still allow the device to function.

Different embodiments of the present invention are disclosed in the dependent claims.

BRIEF DESCRIPTION OF THE RELATED DRAWINGS

Next the invention is described in more detail with reference to the appended drawings, in which FIG. 1 illustrates an embodiment of a track exercise device according to the present invention.

Figure 1:
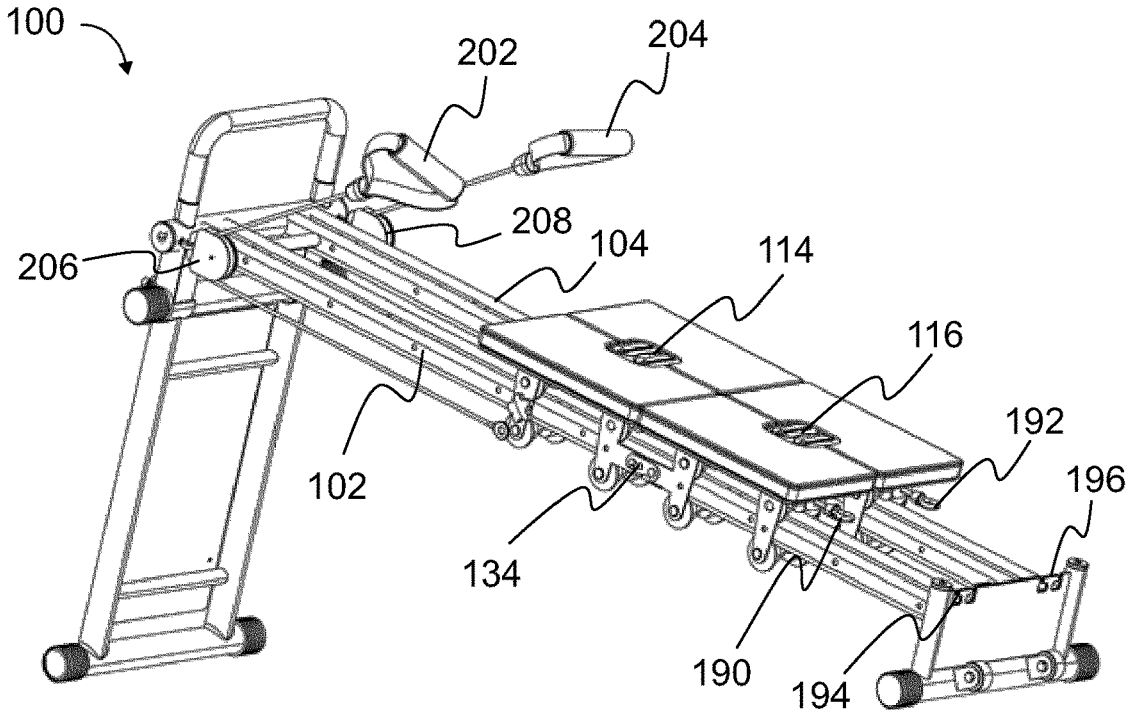
Figure 2:
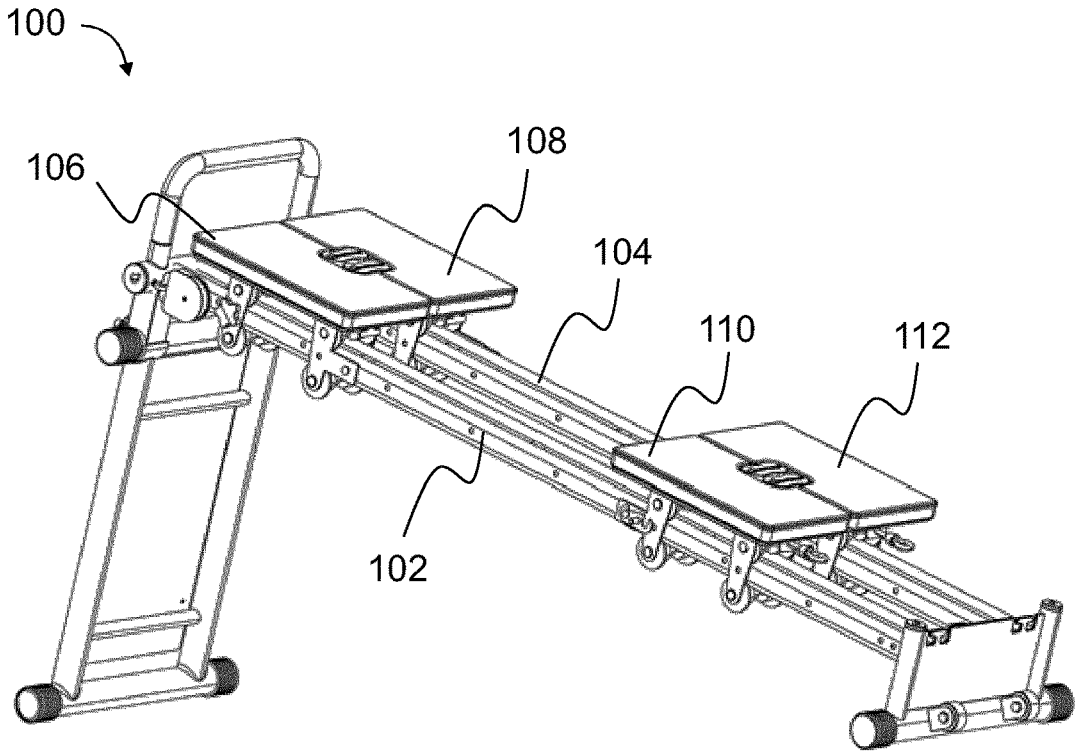
FIG. 2 illustrates an embodiment of a track exercise device with the movable platforms on the same track separated.
Figure 3:
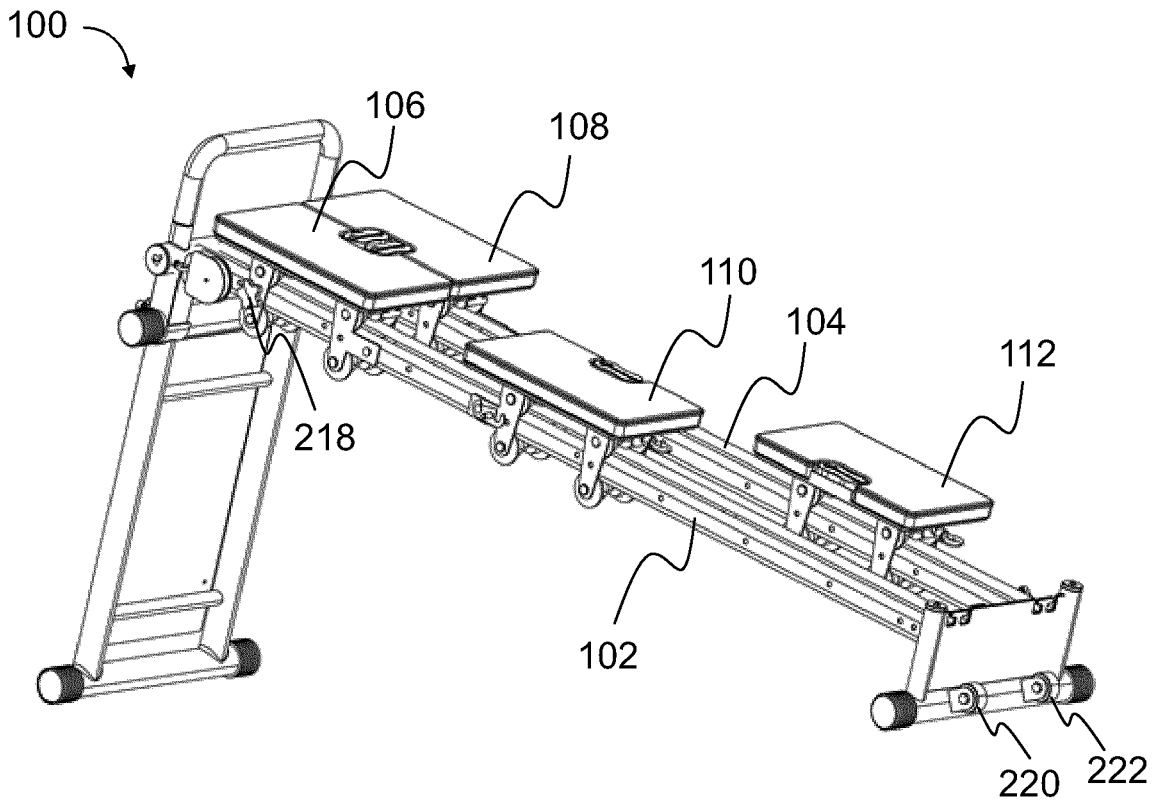
FIG. 3 illustrates an embodiment of a track exercise device with two movable platforms on different tracks separated.
Figure 4:
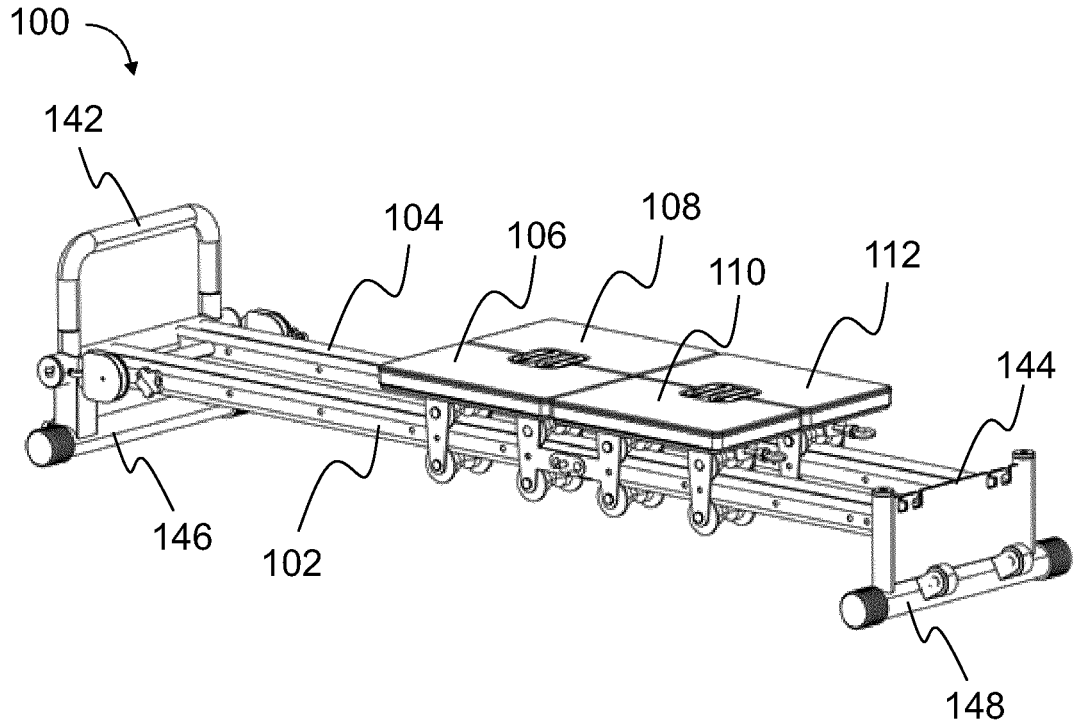
FIG. 4 illustrates an embodiment of a track exercise device in a flat position.
Figure 5:
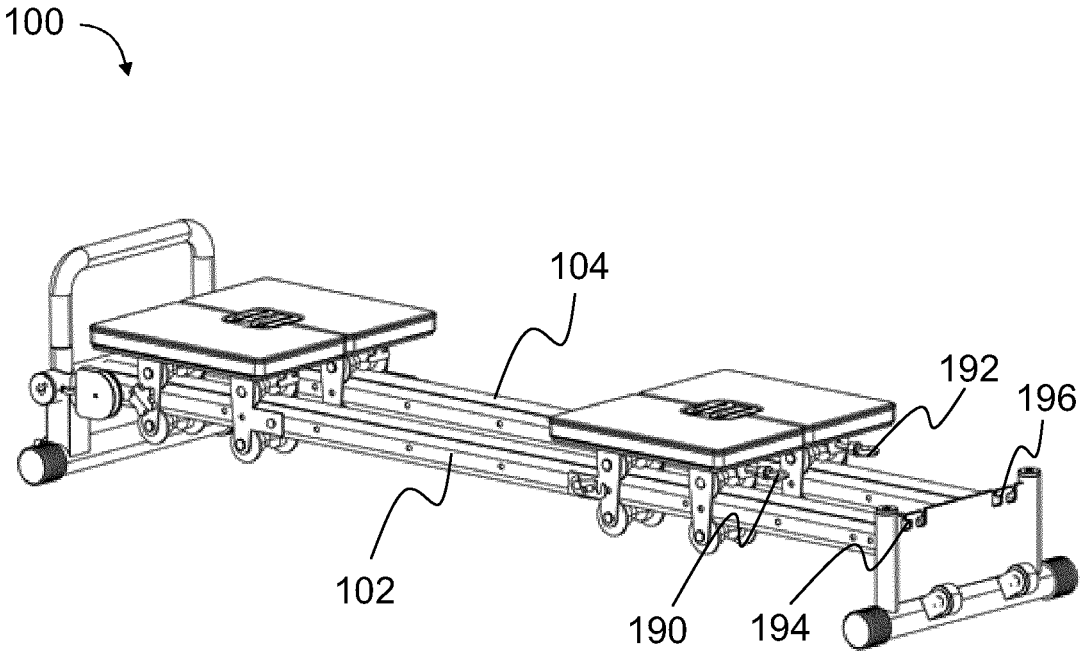
FIG. 5 illustrates an embodiment of a track exercise device in a flat position with the movable platforms on the same track separated.
Figure 6A:
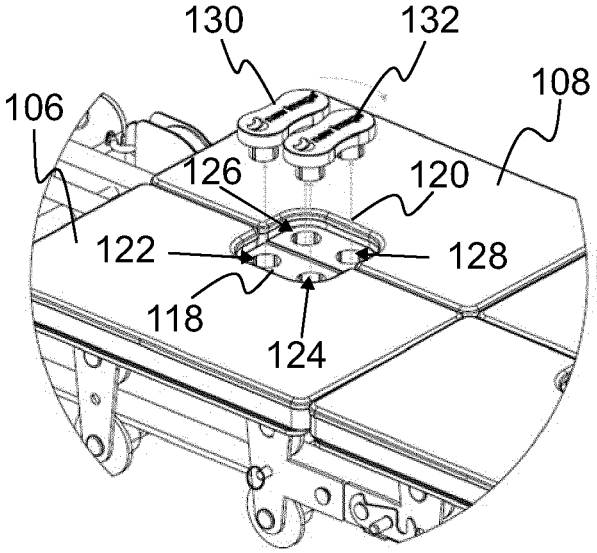
Figure 6B:
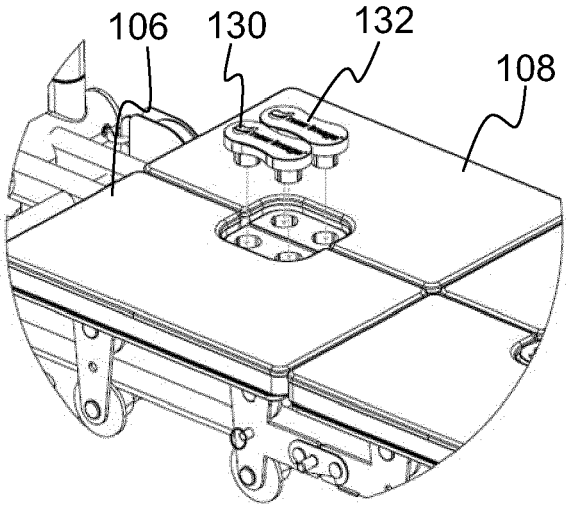

FIGS. 6*a*-6*b* illustrate an embodiment of the transverse attachment means for attaching the movable platforms on different tracks.

Figure 7:
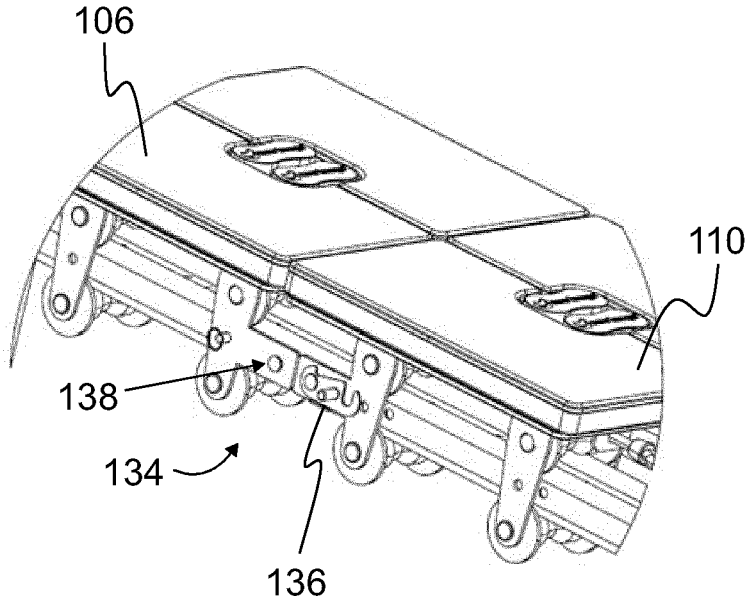

FIG. 7 illustrates an embodiment of the longitudinal attachment means for attaching the movable platforms on the same track.

Figure 8:
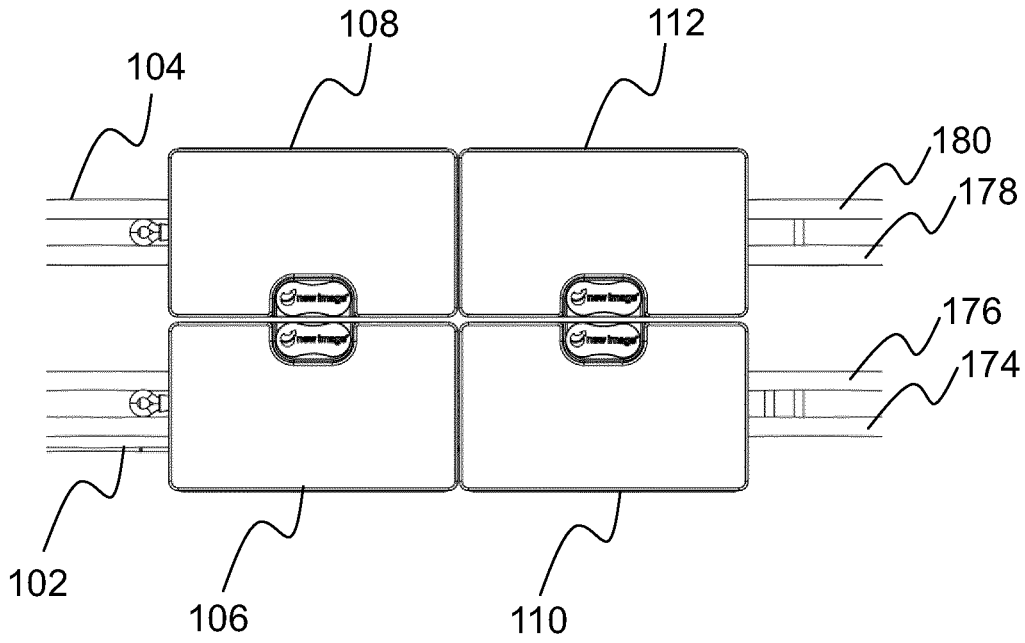

FIG. 8 illustrates a top view of the movable platforms.

Figure 9:
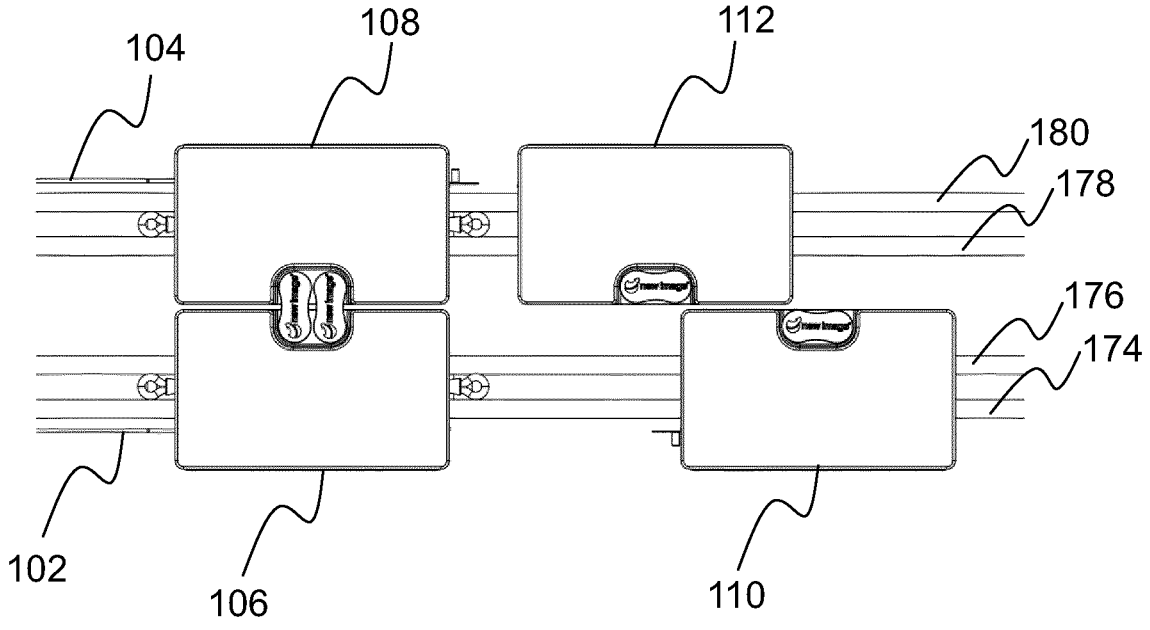

FIG. 9 illustrates a second top view of the movable platforms, wherein two platforms are separated.

Figure 10:
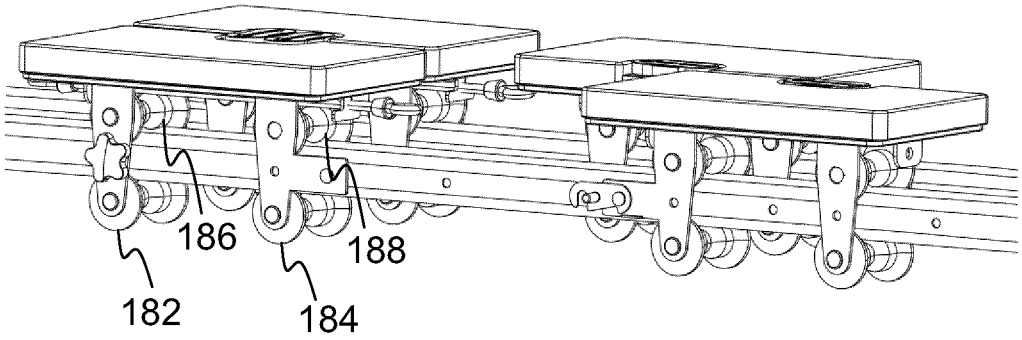

FIG. 10 illustrates a side view of the movable platforms and rollers.

Figure 11:
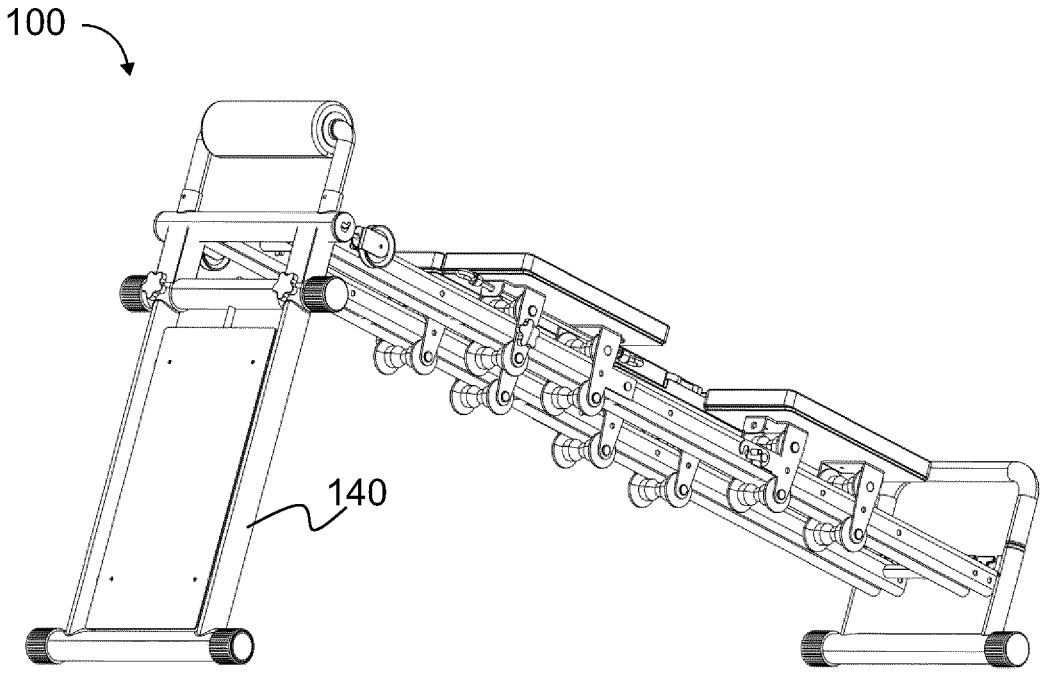

FIG. 11 illustrates a view below the tracks.

Figure 12:
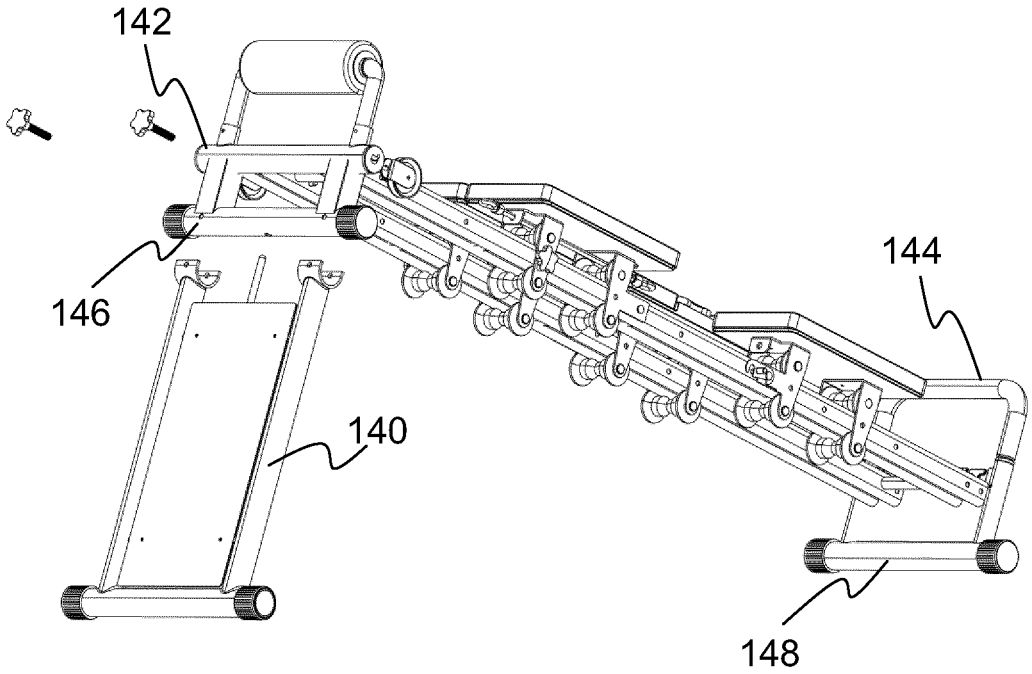

FIG. 12 illustrates the attachment of an incline leg.

Figure 13:
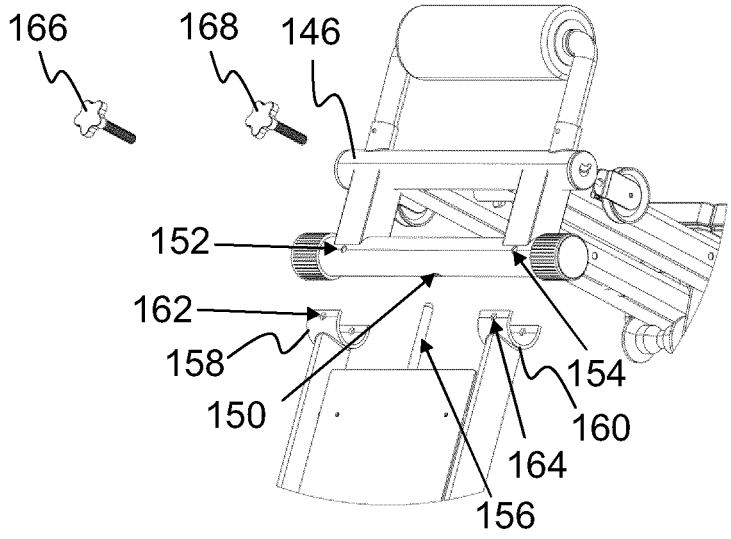

FIG. 13 illustrates a closer view of the attachment of the incline leg.

Figure 14:
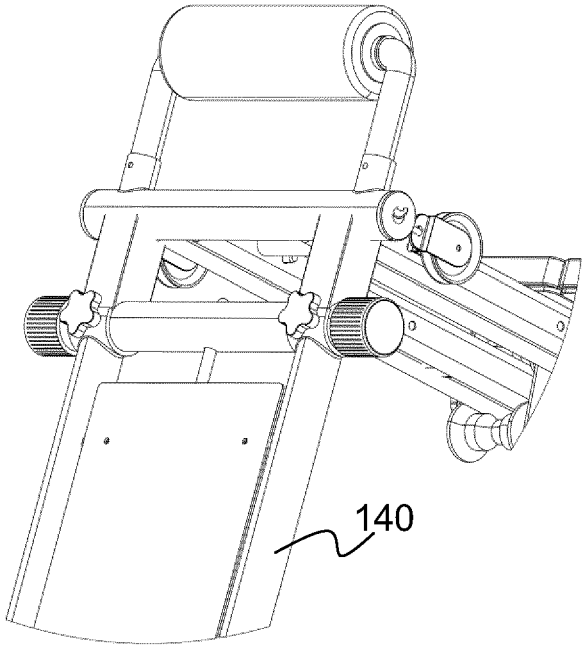

FIG. 14 illustrates the attached incline leg.

Figure 15:
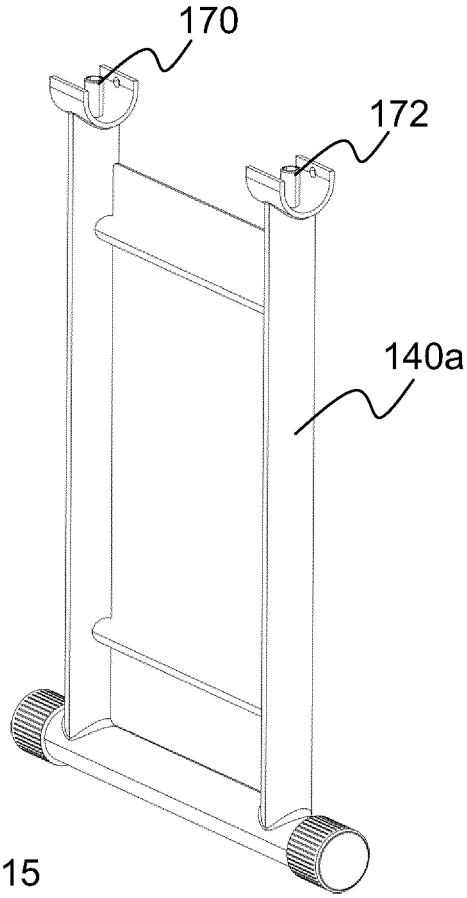

FIG. 15 illustrates an embodiment of the incline leg.

Figure 16:
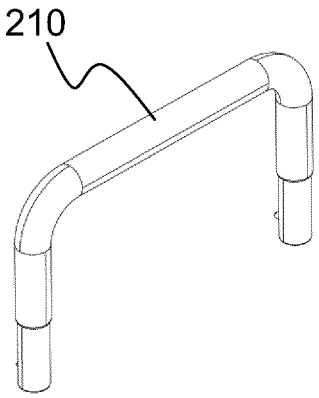

FIG. 16 illustrates a first handle.

Figure 17:
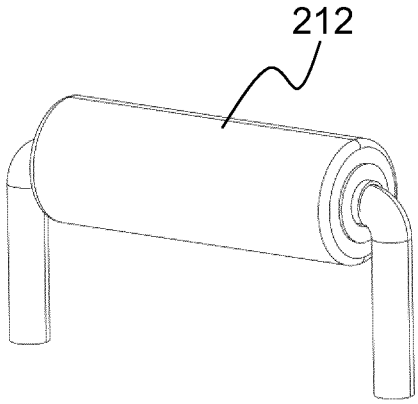

FIG. 17 illustrates a second handle.

Figure 18:
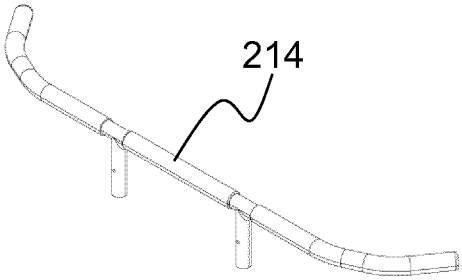

FIG. 18 illustrates a third handle.

Figure 19:
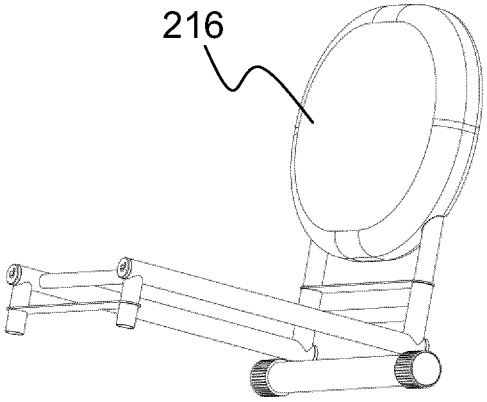

FIG. 19 illustrates a squat platform.

Figure 20:
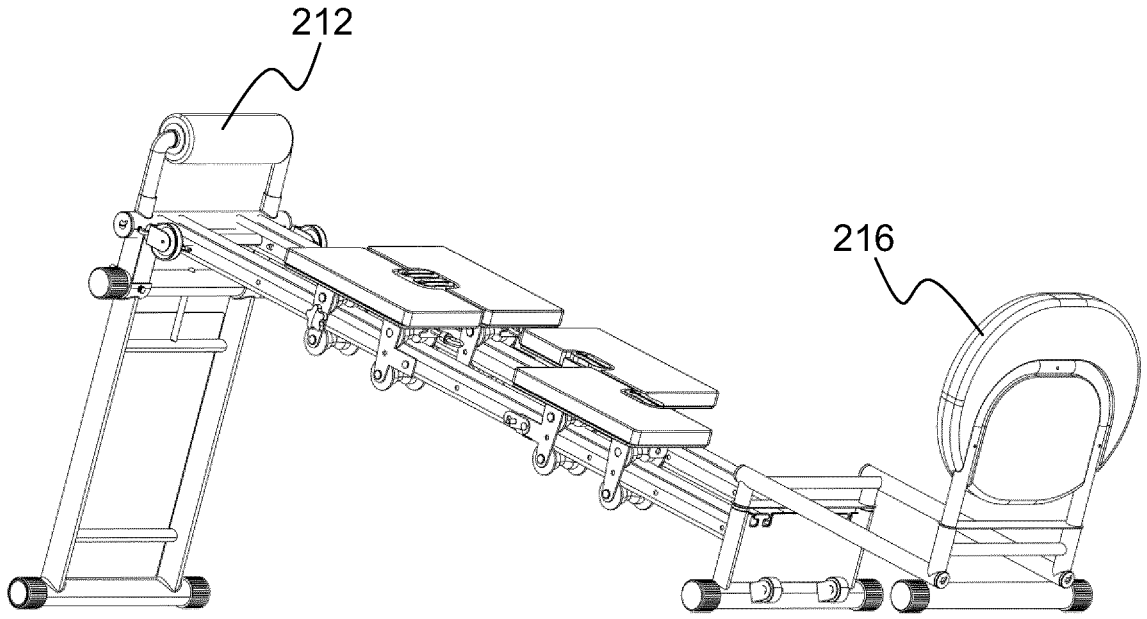

FIG. 20 illustrates an embodiment of the track exercise device with the second handle and squat platform attached.

Figure 21:
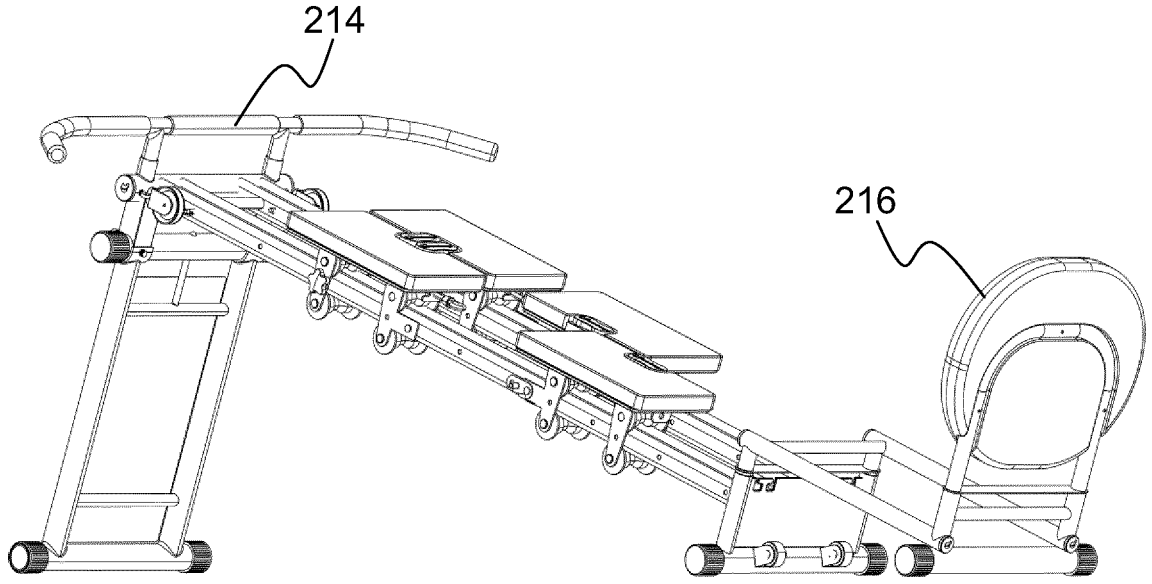
Figure 22:
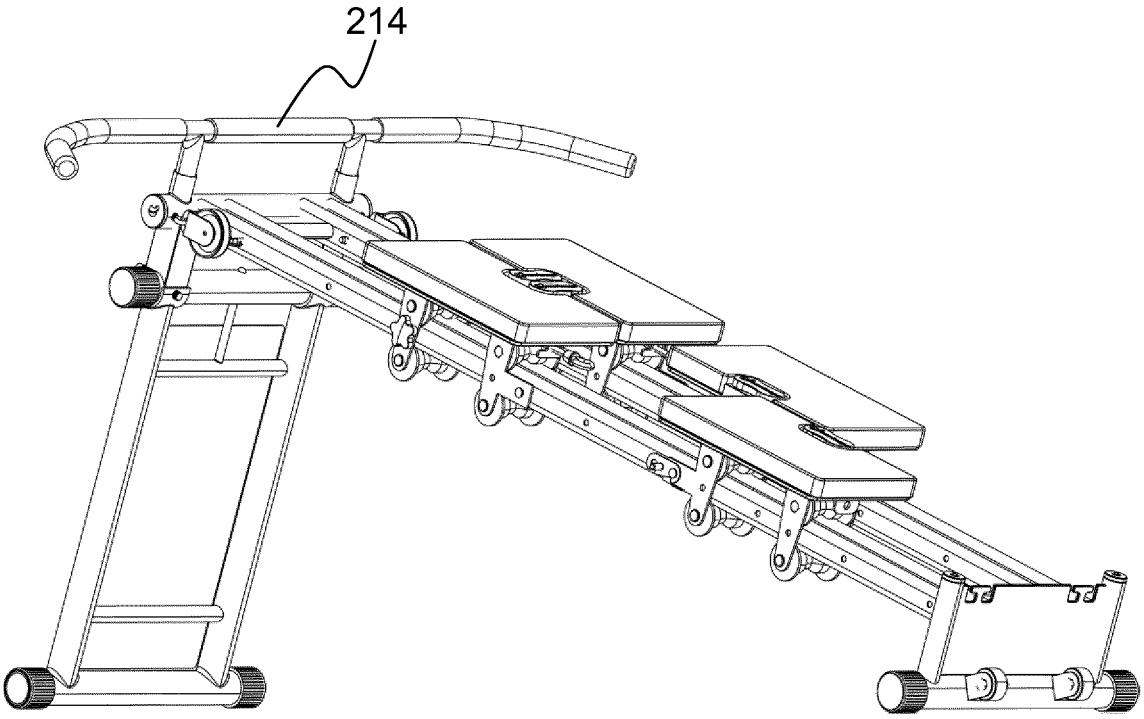

FIG. 21 illustrates an embodiment of the track exercise device with the third handle and squat platform attached.

FIG. 21 illustrates an embodiment of the track exercise device with the third handle attached.

FIGS. 23-30 illustrate some exercise movements possible with the track exercise device.

DETAILED DESCRIPTION OF THE EMBODIMENTS

Referring to FIGS. 1-5, the track exercise device 100 comprises a first and a second track 102, 104. The tracks are substantially parallel.

The track exercise device 100 comprises four movable platforms 106-112. A first and second movable platform 106, 108 are attachable with first transverse attachment means 114. A third and fourth movable platform 110, 112 are attachable with second transverse attachment means 116. The transverse attachment means allow the attachment and release of two movable platforms on different tracks.

Referring to FIGS. 6*a* and 6*b*, the first and second movable platform 106, 108 comprise respectively a first and a second slot 118, 120. The first slot 118 comprises two holes 122, 124 and the second slot 120 comprises two holes 126, 128. The first and second slot 118, 120 may be arranged against each other for attaching the movable platforms. Similarly, the third and fourth movable platform comprise respectively a third and fourth slot with two holes for attaching the movable platforms.

The transverse attachment means 114 comprise a first and a second detachable connecting part 130, 132. Referring to FIG. 6*a*, in a first position, the connecting parts 130, 132, attach the first and second movable platform 106, 108, when the connecting parts are arranged in the holes of both the first and second movable platform 106, 108. Referring to FIG. 6*b*, in a second position, the connecting parts 130, 132 release the first and second movable platform 106, 108, when the first connecting part 130 is arranged in the holes of the first movable platform 106 and the second connecting part 132 is arranged in the holes of the second movable platform 108. Similarly, the third and fourth movable platform may be attached and released. The connecting parts form a flat surface with the movable platforms when arranged in the holes 122-128. The connecting parts may not disturb the user when forming a flat surface with the movable platforms.

The longitudinal attachment means 134 comprise a rotatable hook 136 and an attachment member 138. The longitudinal attachment means allow the attachment and release of two movable platforms on the same track. The first and third movable platform 106, 110 on the first track 102 may be attached with the longitudinal attachment means 134. Similarly, the second and fourth movable platform 108, 112 on the second track 104 may be attached with another longitudinal attachment means (not shown).

A detachable incline leg 140 may be attached to the first end 142 of the track exercise device, below the tracks 102, 104. Alternatively, the detachable incline leg may be attached to the second end 144 of the track exercise device. The track exercise device comprises a first and a second support member 146, 148 for supporting the device against a surface. The exercise device 100 enables a flat movement when the support members 146, 148 are arranged against a (flat) surface. The track exercise device 100 enables an inclined movement when the incline leg 140 is attached to the first support member 146. The first support member 146 comprises three holes 150-154 for attaching the incline leg 140. A stick 156 is arranged in the first hole 150, and the attachment parts 158, 160 of the incline leg are arranged so that the holes 162, 164 of the attachment parts are in line with the holes 152, 154 of the support member 146. Threaded screws 166, 168 may be used to fasten the incline leg 140 to the support member 146. In another embodiment, the incline leg 140*a* comprises two sticks 170, 172 that are arranged respectively in two holes of the support member.

The first and second tracks 102, 104 are double tracks comprising two substantially parallel track bars. The first track 102 comprises a first and second track bar 174, 176 and the second track comprises a third and fourth track bar 178, 180. The double track construction may provide strength and stability compared to a single track construction.

Each movable platform 106-112 comprises four rollers 182-188. Two rollers 182, 184 are arranged below the track and two rollers 186, 188 are arranged above the track. The rollers are double rollers, wherein each roller 182-188 comprises two roll surfaces that are arranged against the track. This roller construction may enable smooth motion of the movable platforms.

The track exercise device 100 comprises a first and a second elastic band 190, 192 for providing resistance or assistance. The first and second elastic band 190, 192 may be attached from a first end to the first and second movable platforms 106, 108 or the third and fourth movable platforms 110, 112. The first and second elastic band 190, 192 may be attached from a second end to the second end 144 of the track exercise device respectively to a first and second attachment point 194, 196.

A first and second pull handle 202, 204 may be attached respectively to the first and second movable platform 106, 108. The pull handles 202, 204 are attached to the movable platforms via a first and second pulley 206, 208.

A first, second or third detachable handle 210, 212, 214 may be attached to the first end 142 of the track exercise device. The first detachable handle 210 is a grip bar. The grip bar allows the user to grip the first end of the device. The second detachable handle 212 is a roll bar. The roll bar may provide user comfort, for example, when placing one's head at the first end. The third detachable handle 214 is a lat bar, allowing the user to take a wider grip for the exercises.

A squat platform 216 may be arranged to the second end 144 of the track exercise device. A user may perform, for example, lying squat movements with the squat platform.

The first and second movable platform 106, 108 comprise a locking mechanism 218 for locking the movable platforms to a certain position on the track. For example, for some exercise movements, the first and second movable platform may be locked near the first end 142 of the track exercise device.

The track exercise device comprises wheels 220, 222 at the second end 144 for moving the device.

Figure 23:
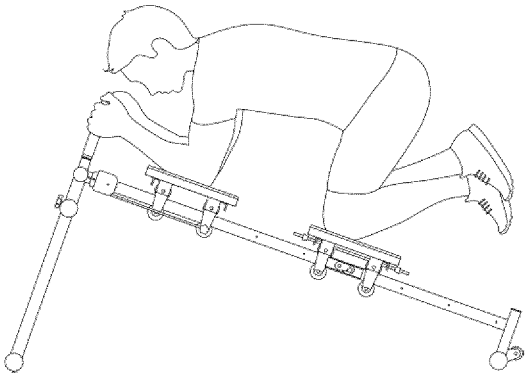
Figure 24:
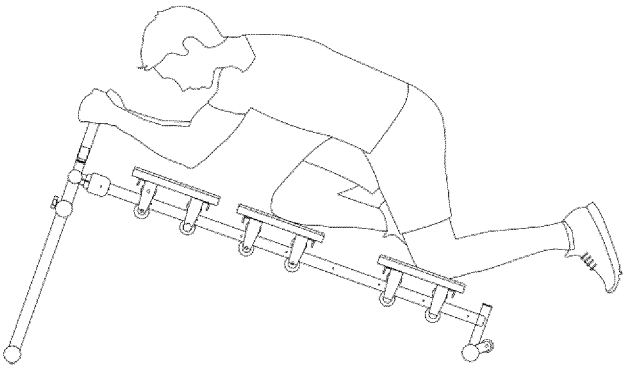
Figure 25:
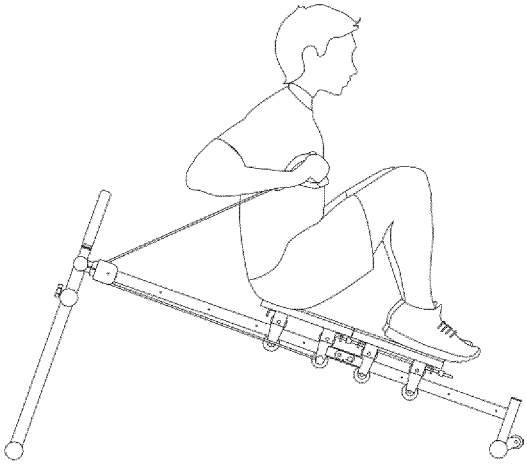
Figure 26:
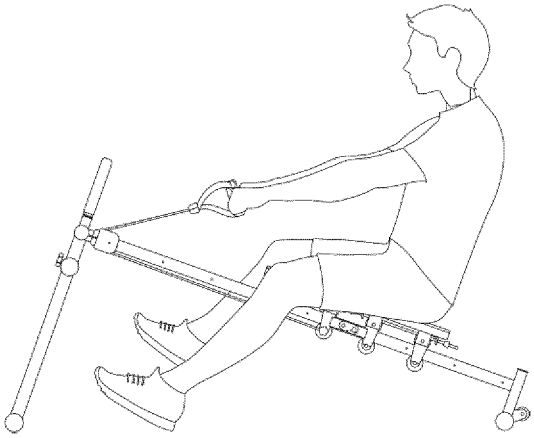
Figure 27:
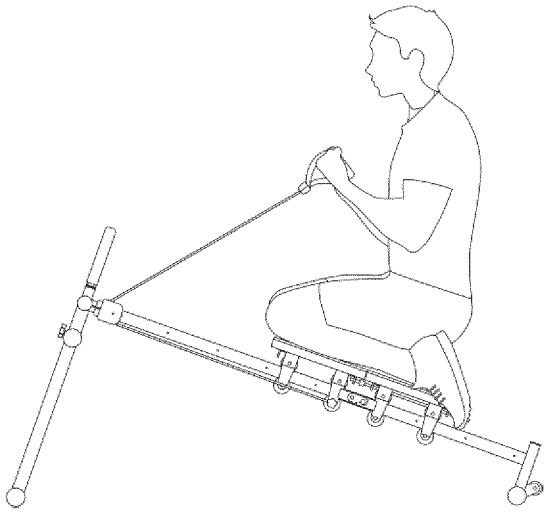
Figure 28:
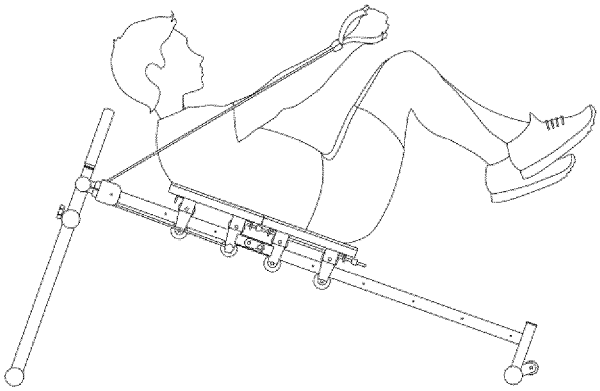
Figure 29:
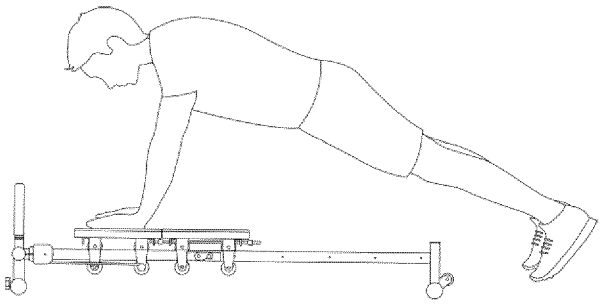
Figure 30:
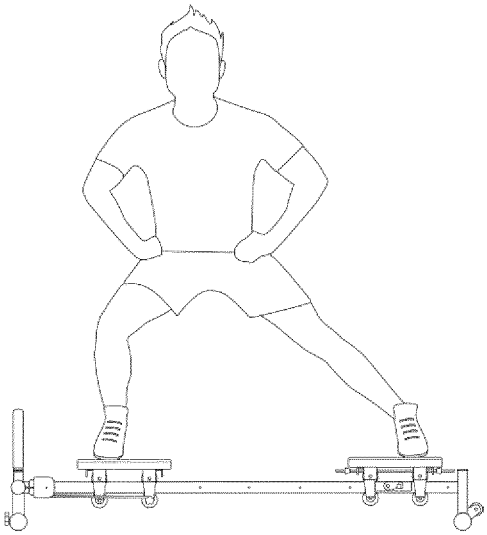

Eight different example movements are illustrated in FIGS. 23-30. FIG. 23 illustrates an ab movement where the user may pull both knees up to his/her chest. FIG. 24 illustrates another ab movement where the user may pull up the knees in turns, so that when the left knee is pulled up, the right knee drops down and vice versa. FIG. 25 illustrates a chest press movement where the user pushes his/her hands straight out in front. FIG. 26 illustrates a back movement or row movement where the user may pull the handles. FIG. 27 illustrates a bicep movement where the user may lock the elbows to the sides and pull the handles to the shoulders. FIG. 28 illustrates a triceps extension where the user may start with the hands near the head and extend the arms in front of him/her by bending only from the elbows. FIG. 29 illustrates an ab movement where the user may place the hands on top of the movable platforms and push down the tracks before pulling back to start. FIG. 30 illustrates a leg movement where the user may push one leg to the side and pull back to the standing leg.

Consequently, a skilled person may, on the basis of this disclosure and general knowledge, apply the provided teachings in order to implement the scope of the present invention as defined by the appended claims in each particular use case with necessary modifications, deletions, and additions.

The invention claimed is:

1. A track exercise device, comprising:

first and second tracks arranged substantially parallel to one another;

first, second, third, and fourth movable platforms, wherein the first and third movable platforms are on the first track, and the second and fourth movable platforms are on the second track;

transverse attachment means for respectively attaching the first and second movable platforms together on the first and second tracks and the third and fourth movable platforms together on the first and second tracks;

longitudinal attachment means for attaching the first and third movable platforms together on the first track and the second and fourth movable platforms together on the second track; and tilting means for inclining the first and second tracks to facilitate any of inclined or flat movement of the moveable platforms relative to a ground surface.

2. The track exercise device of claim 1, wherein at least the first and the second movable platforms comprise respectively a first and a second slot, each slot comprising at least two holes, and wherein the transverse attachment means comprise at least first and second detachable connecting parts that, in a first position, attach the first and the second movable platforms when the first and the second detachable connecting parts are respectively arranged in the at least two holes of both the first and the second movable platforms, and, in a second position, the first and second detachable connecting parts release the first and the second movable platforms when the first detachable connecting part is arranged in the at least two holes of the first movable platform and the second detachable connecting part is arranged in the at least two holes of the second movable platform.

3. The track exercise device of claim 2, wherein the first and the second detachable connecting parts respectively form a flat surface with the first and the second movable platforms.

4. The track exercise device of claim 3, wherein the longitudinal attachment means comprise a first rotatable hook for attaching the first and third movable platforms together on the first track and a second rotatable hook for attaching the second and fourth movable platforms together on the second track.

5. The track exercise device of claim 3, wherein the tilting means comprise at least one detachable incline leg that is attachable to a first end of the track exercise device below the first and the second tracks.

6. The track exercise device of claim 2, wherein the longitudinal attachment means comprise a first rotatable hook for attaching the first and third movable platforms together on the first track and a second rotatable hook for attaching the second and fourth movable platforms together on the second track.

7. The track exercise device of claim 2, wherein the tilting means comprise at least one detachable incline leg that is attachable to a first end of the track exercise device below the first and the second tracks.

8. The track exercise device of claim 1, wherein the longitudinal attachment means comprise:

a first rotatable hook for attaching the first and third movable platforms together on the first track; and a second rotatable hook for attaching the second and fourth movable platforms together on the second track.

9. The track exercise device of claim 1, wherein the tilting means comprise at least one detachable incline leg that is attachable to a first end of the track exercise device below the first and the second tracks.

10. The track exercise device of claim 1, wherein each one of the first and the second tracks is formed of a double track comprising two substantially parallel track bars for providing strength and stability to a structure of the track exercise device.

11. The track exercise device of claim 1, wherein each one of the first, second, third, and fourth movable platforms comprises a plurality of double rollers, each double roller having two roll surfaces.

12. The track exercise device of claim 11, wherein for each of the first, second, third, and fourth movable platforms, the plurality of double rollers comprises four double rollers, a first two of the four double rollers arranged above the corresponding first or second track and a second two of the four double rollers arranged below the corresponding first or second track for smooth motion.

13. The track exercise device of claim 1, further comprising:

at least one elastic band for providing resistance or assistance for exercise movements.

14. The track exercise device of claim 13, wherein the at least one elastic band comprises at least a first elastic band and a second elastic band, attachable respectively to the first and second movable platforms, and to first and second attachment points at one end of the track exercise device.

15. The track exercise device of claim 1, further comprising:

at least two pull handles.

16. The track exercise device of claim 15, further comprising:

at least two pulleys, wherein the at least two pull handles comprise a first pull handle and a second pull handle, respectively attached via a first pulley and a second pulley of the at least two pulleys to the first and second movable platforms.

17. The track exercise device of claim 1, further comprising:

at least one detachable handle attachable to a first end of the track exercise device.

18. The track exercise device of claim 17, wherein the at least one detachable handle is at least one selected from the group of: a grip bar, a roll bar, and a lat bar.

19. The track exercise device of claim 1, further comprising:

a detachable squat platform attachable to a second end of the track exercise device.

* * * * *